US007855331B1

(12) United States Patent
Chen

(10) Patent No.: US 7,855,331 B1
(45) Date of Patent: Dec. 21, 2010

(54) PEDAL SYSTEM AND A DRUM ASSEMBLY USING THE SAME

(76) Inventor: Kuo-Chang Chen, 6980 Whiteoak Drive, Richmond, B.C. (CA) V7E 4Z9

( * ) Notice: Subject to any disclaimer, the term of this patent is extended or adjusted under 35 U.S.C. 154(b) by 0 days.

(21) Appl. No.: 12/620,516

(22) Filed: Nov. 17, 2009

(51) Int. Cl.
*G10D 13/02* (2006.01)

(52) U.S. Cl. ..... 84/422.1

(58) Field of Classification Search ..... 84/422.1, 84/422.3, 421
See application file for complete search history.

(56) References Cited

U.S. PATENT DOCUMENTS 7,135,633 B2 * 11/2006 Miyajima et al. ..... 84/422.1

* cited by examiner

*Primary Examiner*—Kimberly R Lockett

(57) ABSTRACT

A pedal system includes a support element, a connecting shank, a transmission element and a returning element. The support element has a pedal and a rotatable axle. The axle inserts through the connecting shank in a rotational operative relationship. The returning element includes a connecting body, a rod unit, a positioning element and a resilient member. The connecting body is disposed on the axle. The resilient member connects between the connecting body and a connecting end of the rod unit. The connecting end of the rod unit is movable with respect to the support element so as to adjust an angle included between an orientation of the resilient member and that of an upright frame of the support element. The positioning element selectively fixes a relative position between the rod unit and the support element, so as to further fix the angle.

9 Claims, 8 Drawing Sheets

PEDAL SYSTEM AND A DRUM ASSEMBLY USING THE SAME

BACKGROUND OF THE INVENTION

1. Field of the Invention

The present invention relates to a pedal system for a percussion instrument, and more particularly for a drum.

2. Description of the Prior Art

Some of the conventional drum assemblies each includes a pedal system for the player to percuss the drum by foot. The pedal system is usually provided with a resilient means to retain the pedal at the release position while not stepped upon.

The applicant's prior granted U.S. Pat. No. 7,301,088 discloses an adjustable drum pedal assembly. The pedal assembly includes a stationary bracket (20) attached to a post (52). The stationary bracket (20) receives a rotatable collar (34) therein, and a drive column (31) connects between the rotatable collar (34) and a spring (71). It is noted that the rotatable collar (34) is mainly rotatable when the pedal is stepped, and that the rotatable collar (34) eventually returns to a predetermined position/angle with respect to the bracket (20) as the pedal is released.

SUMMARY OF THE INVENTION

The main object of the present invention is to provide a pedal system whose tension of the resilient member is adjustable.

To achieve the above and other objects, a pedal system of the present invention includes a support element, a connecting shank, a transmission element and a returning element. The support element has a pedal and a rotatable axle. The axle inserts through the connecting shank in a rotational operative relationship. The returning element includes a connecting body, a rod unit, a positioning element and a resilient member. The connecting body is disposed on the axle in a rotational operative relationship. The resilient member connects between the connecting body and a connecting end of the rod unit, and the resilient member provides a resilient force to retain the axle to a predetermined position, moving the pedal to a release position. The connecting end of the rod unit is movable with respect to the support element so as to adjust an angle included between an orientation of the resilient member and that of the upright frame. The positioning element selectively fixes a relative position between the rod unit and the support element, so as to further fix the angle.

Thereby, the tension of the resilient member is adjustable and selectively fixed.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
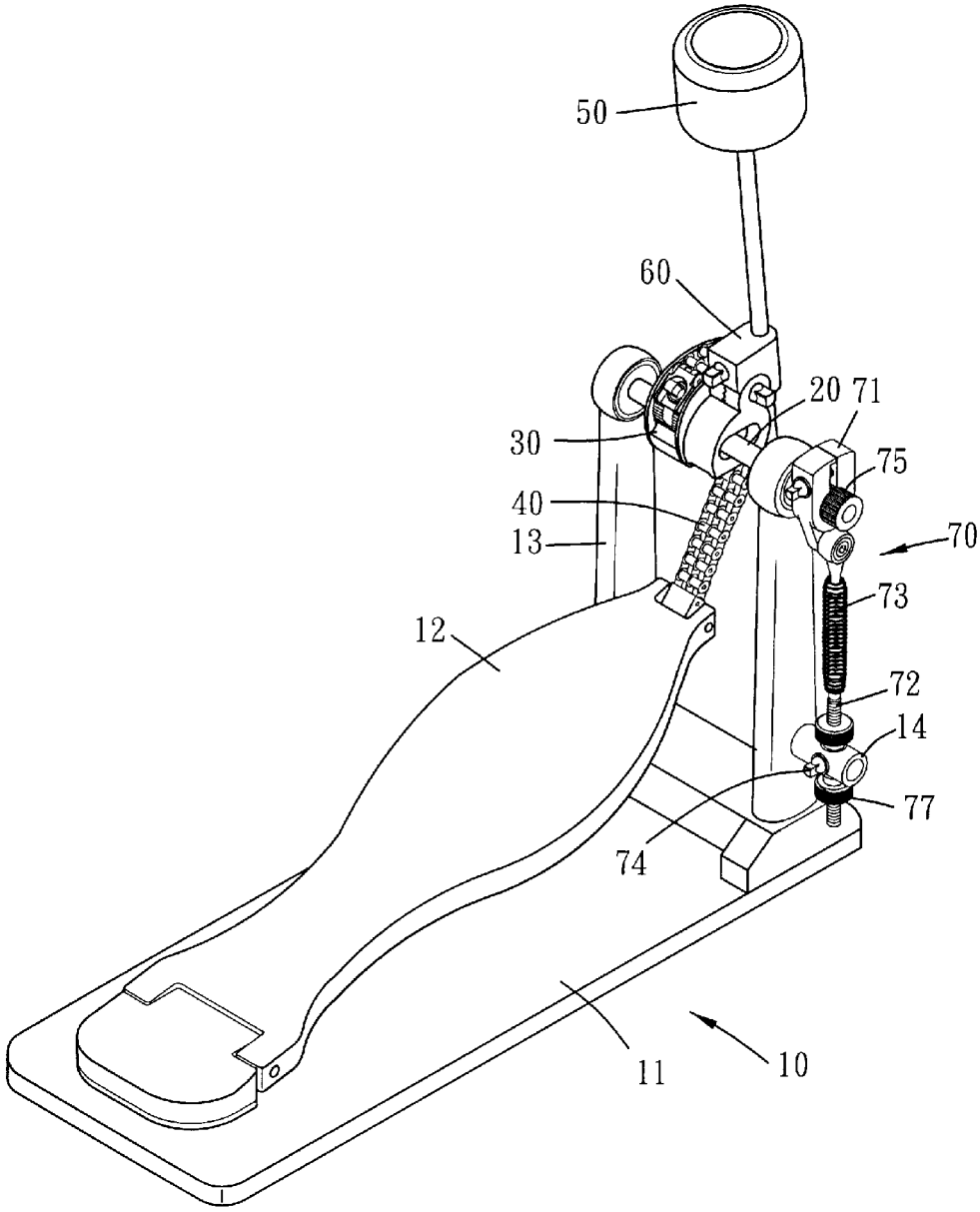
FIG. 1 is a perspective drawing showing a pedal system of the present invention.
Figure 2:
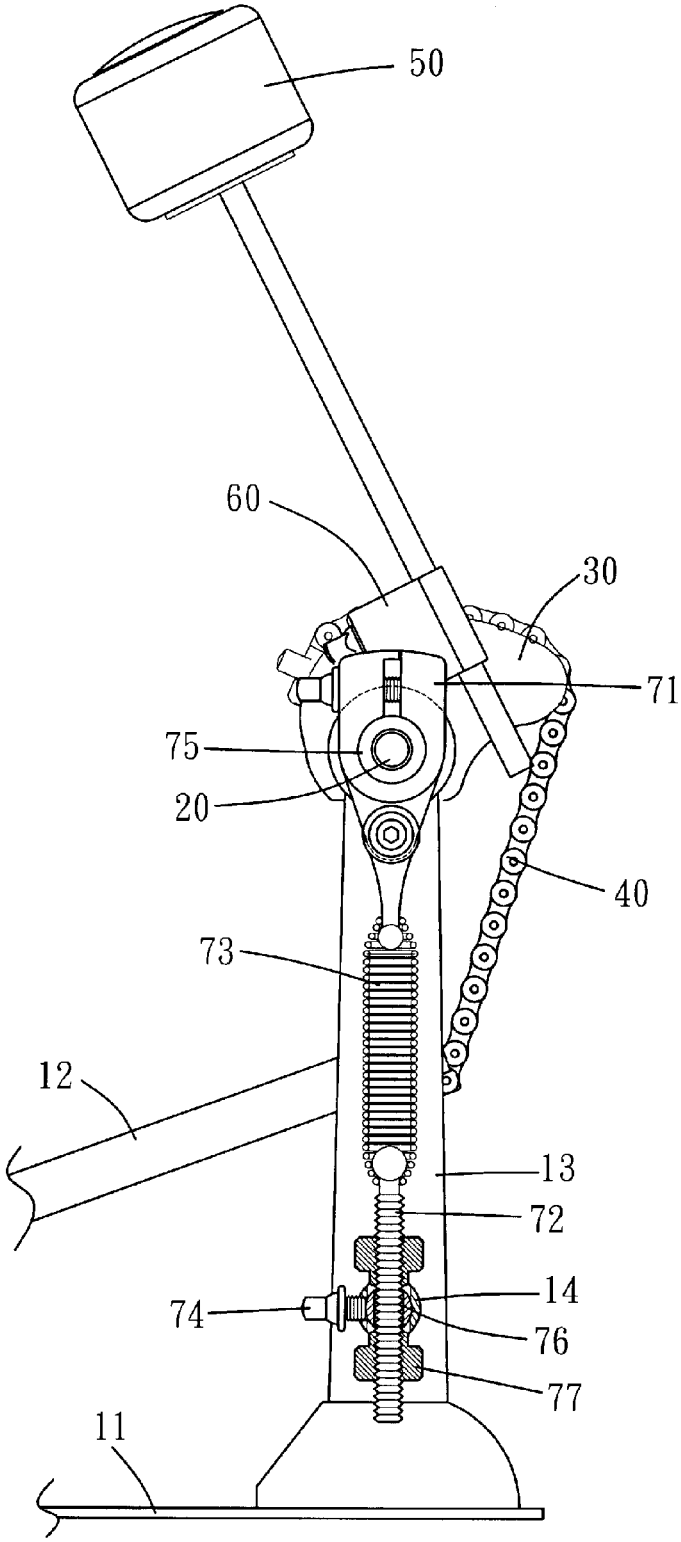
FIG. 2 is a lateral view showing a pedal system, with its pedal at the release position, of the present invention.
Figure 3:
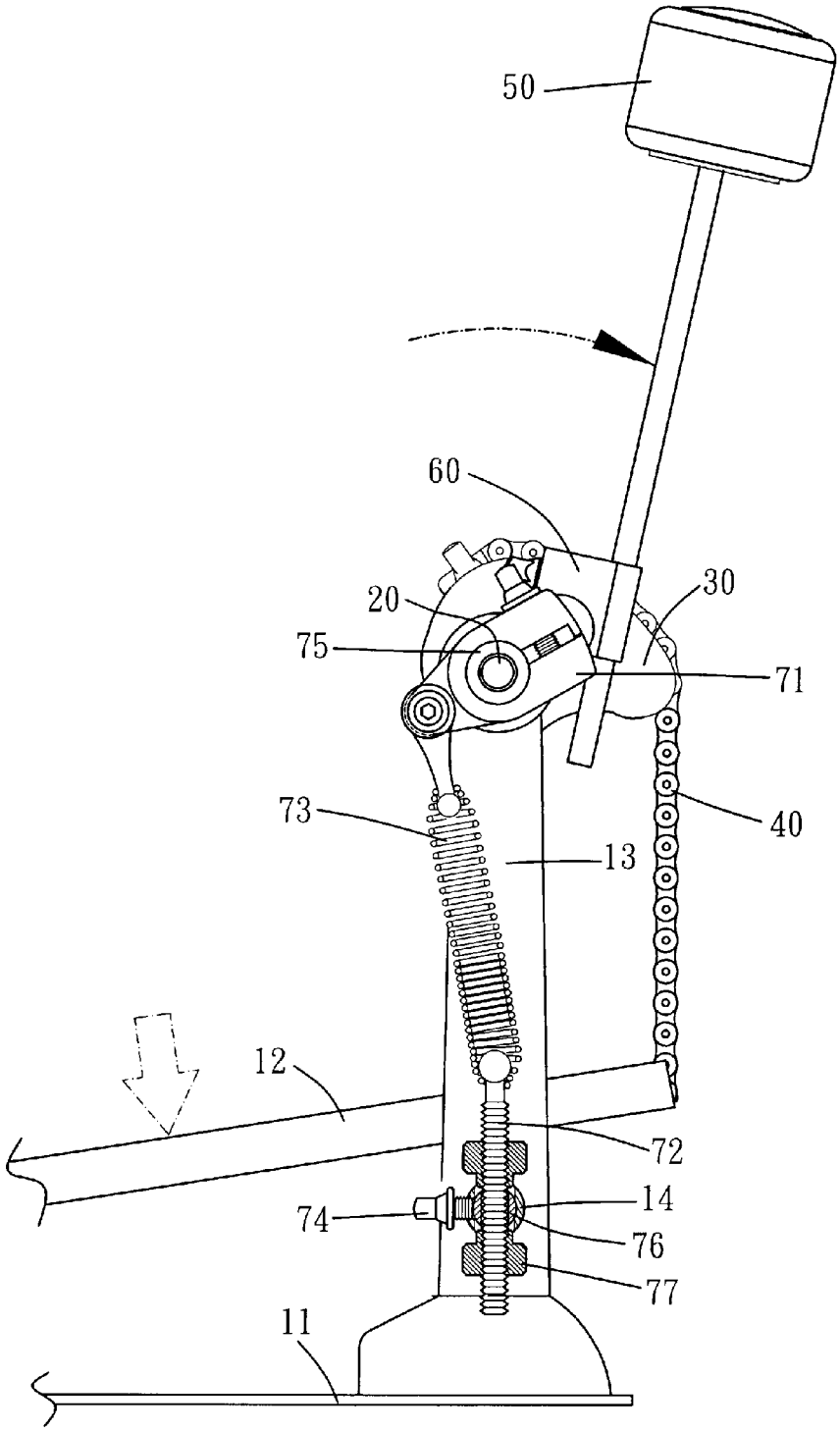
FIG. 3 is a lateral view showing a pedal system, with its pedal at the percussion position, of the present invention.
Figure 4:
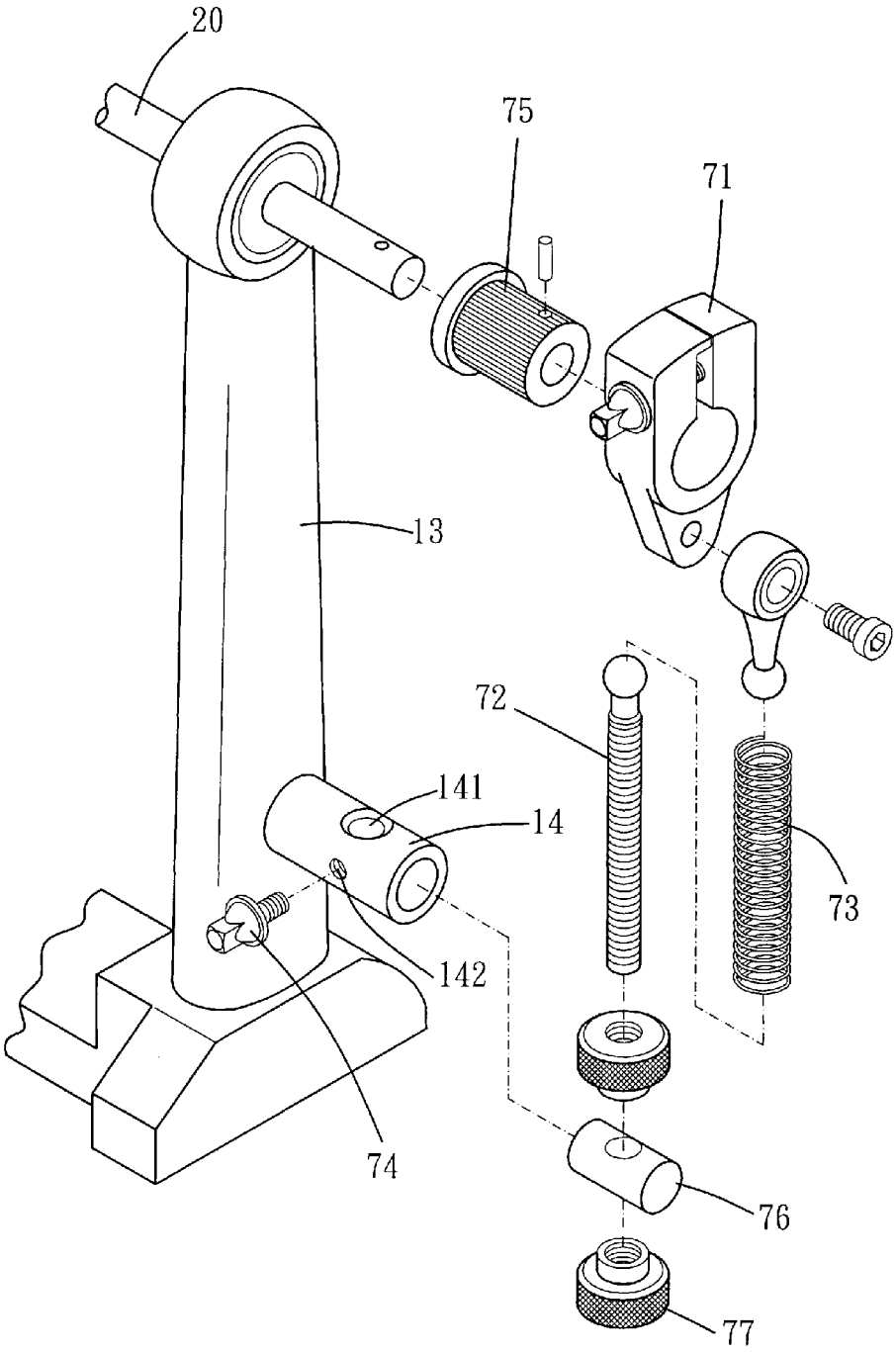
FIG. 4 is a breakdown drawing showing a returning element of the present invention.

Please refer to FIG. 1 to FIG. 3. A pedal of the present invention includes a support element 10. The support element 10 includes a pedal base 11 having a pedal 12 pivotably disposed thereon. As shown in FIG. 1 and FIG. 2, the pedal 12 locates at a release position when it is not stepped upon. As shown in FIG. 3, the pedal 12 moves to a percussion position when it is stepped upon. Two upright frames 13 are disposed on a side of the pedal base 11, and an axle 20 is rotatably disposed between distal ends of the upright frames 13. Note that the axle 20 can also be supported by a single upright frame. The axle 20 inserts through a connecting shank 30 and a fixation element 60 in a rotational operative relationship, e.g. the axle 20 may have a non-circular profile for the shank 30 and the fixation element 60 to engage therewith. A transmission element 40 connects between the pedal 12 and the connecting shank 30, so that the pedal 12 and the connecting shank 30 are in a motional operative relationship. The transmission element 40 may be a chain, as shown in the drawings, a connecting rod or a belt. A drum hammer 50 is disposed on the fixation element 60 as shown in the present embodiment, yet the drum hammer 50 may be disposed on the connecting shank 30 instead. As such, the connecting shank 30, the fixation element 60 and the hammer 50 are all rotatable about the axle 20 as the pedal pivots between the release position and the percussion position.

Figure 5:
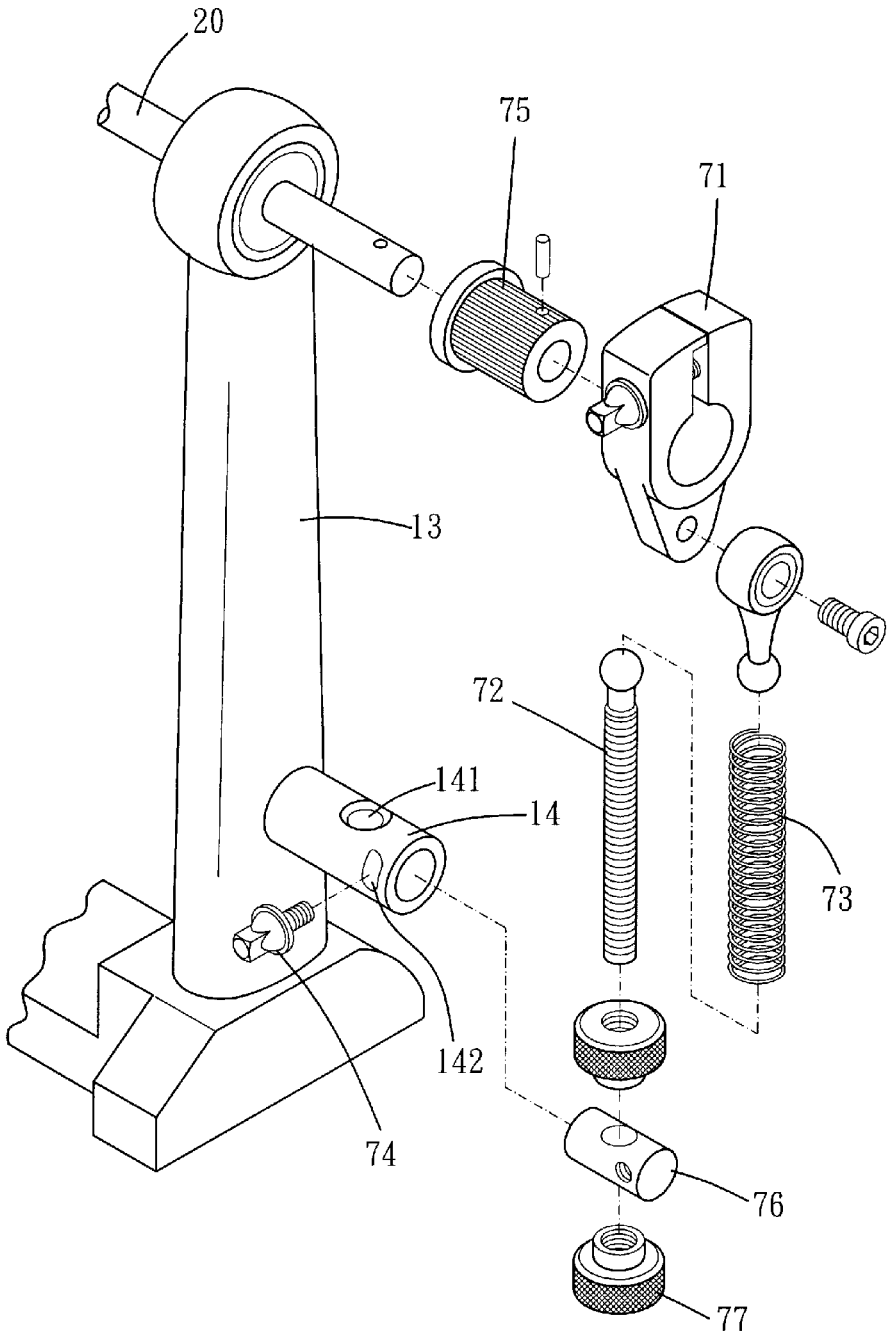
FIG. 5 is a breakdown drawing showing a returning element in accordance with another embodiment of the present invention.

Please refer to FIG. 1 to FIG. 4. The pedal system of the present invention is further provided with a returning element 70, which includes a connecting body 71, a rod unit 72, a resilient member 73, a positioning element 74 and a cylindrical body 76. The connecting body 71 clamps the axle 20 in a rotational operative relationship and preferably with the help of a clamping element 75. The resilient member 73 connects between the connecting body 71 and a connecting end of the rod unit 72, and the resilient member 73 provides a resilient force to retain the axle 20 to a predetermined position so as to move the pedal 12 to the release position as the pedal 12 is not stepped upon. The cylindrical body 76 is rotatably disposed on the support element 10. Specifically, the support element 10 includes a sleeve 14 disposed on the upright frame 13, and an axis of the sleeve 14 is perpendicular to an orientation of the upright frame 13. The cylindrical body 76 is received in the sleeve 14. The sleeve 14 has two opposite first bores 141 for the rod unit 72 to radially insert through the sleeve 14, and the sleeve 14 further has a second bore 142 disposed on a periphery thereof. Note that the bore diameter of the first bores 141 are significantly larger than the cross section of the rod unit 72, such that the rod unit 72 is swayable in the first bores 141. As such, the connecting end of the rod unit 72 is movable with respect to the support element 10 so as to adjust an angle included between an orientation of the resilient member 73 and that of the upright frame 13, and the positioning element 74 selectively fixes a relative position between the rod unit 72 and the support element 10 so as to further fix the angle. Specifically, the cylindrical body 76 has a radial bore for the rod unit 72 to radially dispose thereon, and the positioning element selectively positions the cylindrical body 76 with respect to the support element 10, i.e. the sleeve 14. More specifically, the positioning element 74 inserts through the second bore and selectively urges the cylindrical body 76 to tightly abut against the sleeve 14. In one embodiment shown in FIG. 4, the second bore is threaded for the positioning element 74 to engage therewith. Or, in another embodiment shown in FIG. 5, the second bore is an elongated slot for the positioning element 74 to insert therethrough and to further engage with a threaded bore of the cylindrical body 76. Two threaded units 77 threadedly engage with the rod unit 72 and locate at opposite sides of the sleeve 14 to clamp the sleeve 14 therebetween. As such, the threaded units 77 can be rotated to adjust a height of the rod unit 72, moving the rod unit 72 close to or away from the connecting body 71.

Figure 8:
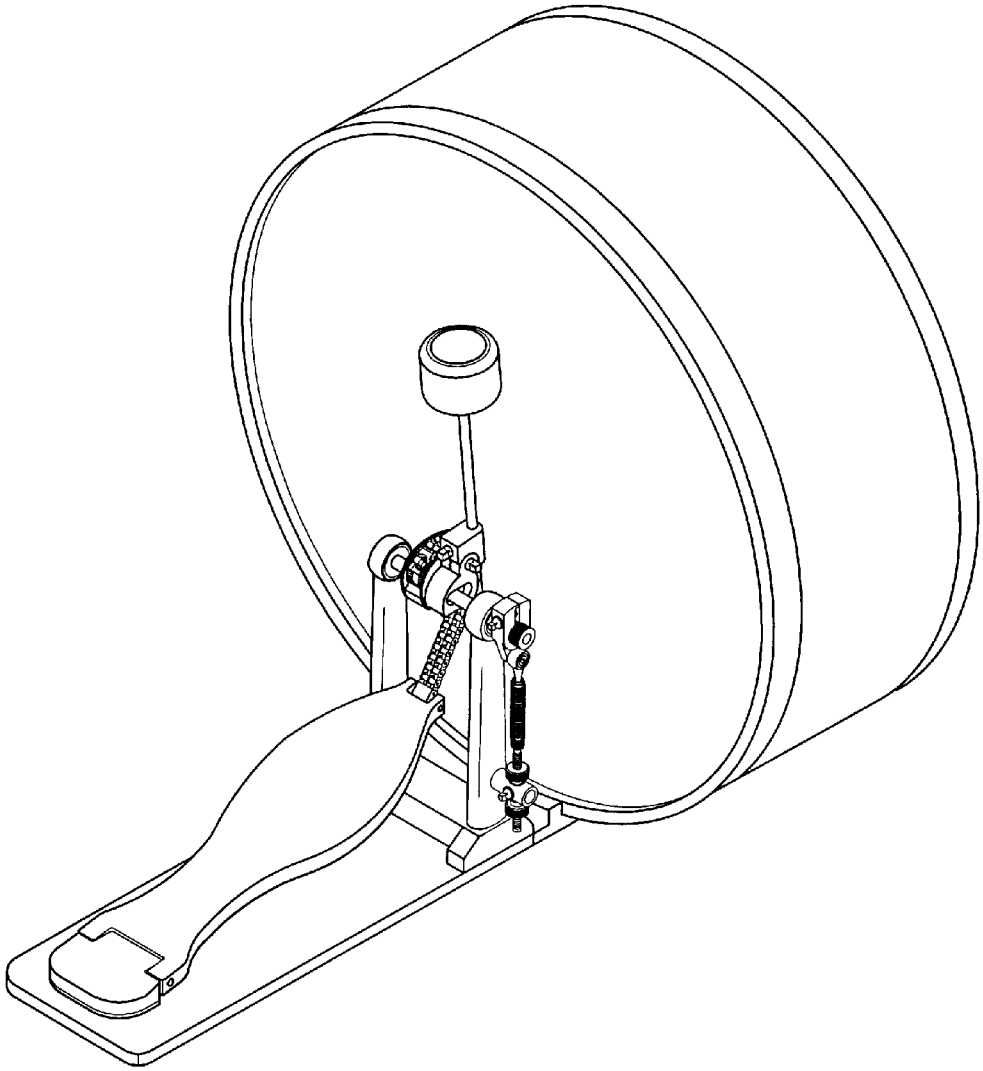
FIG. 8 is a perspective drawing showing a drum assembly of the present invention.

Please refer to FIG. 8. The pedal system of the present invention can be assembled with a drum. Specifically, the drum has a drum skin for the drum hammer 50 to strike thereupon to make sounds.

Figure 6:
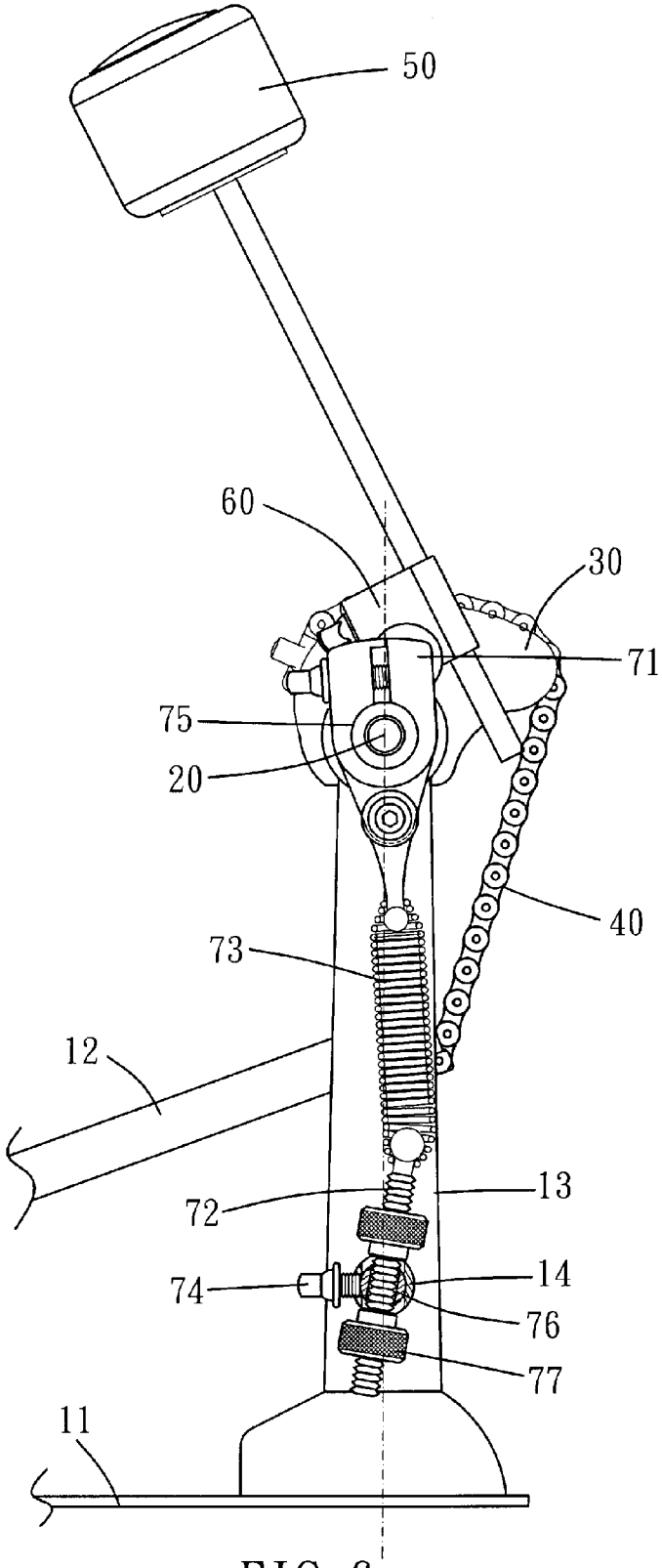
FIG. 6 is a lateral view showing a pedal system, with its pedal at the release position, of the present invention.
Figure 7:
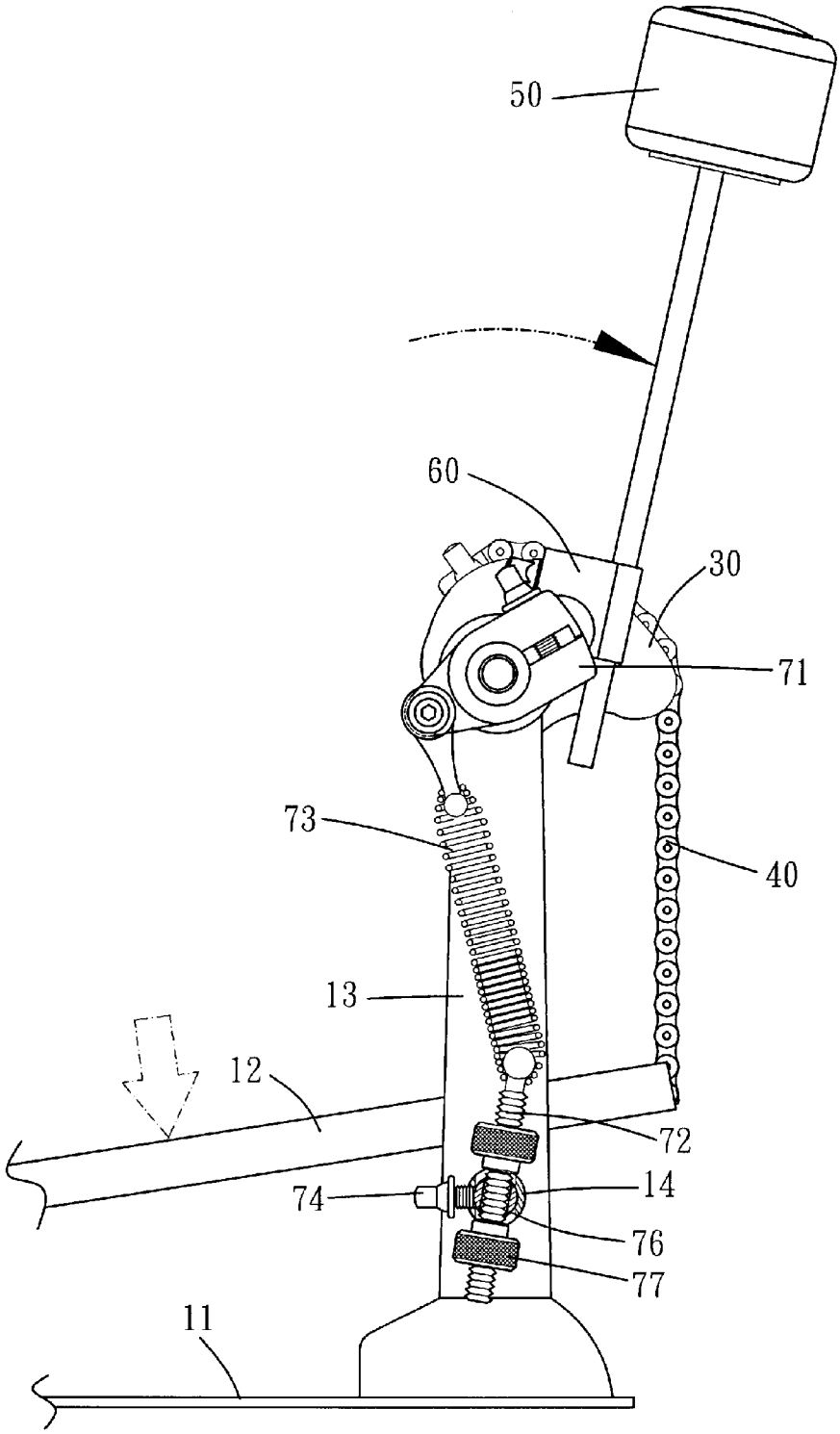
FIG. 7 is a lateral view showing a pedal system, with its pedal at the percussion position, of the present invention.

The positioning element 74 can be loosened for the cylindrical body 76 to freely rotatable about the axis of the sleeve 14. Once the rod unit 72 is slanted clockwise, as shown in FIG. 6, the positioning element 74 is screwed to tightly fix the cylindrical body 76 with the sleeve 14. As such, the angle included between the orientation of the resilient member 73 and that of the upright frame 13 is adjusted and fixed, altering the tension of the resilient member 73. In such case, the pedal system, and more specifically the resilient member 73, provides the player with a different and unique feedback as the player steps upon the pedal 12 as shown in FIG. 7. It is noted that the connecting end of the rod unit 72 is more remote (than usual) from the connecting body 71 as the connecting body 71 rotates clockwise, as shown in FIG. 7, thus providing more damping effect. If, on the other hand, the rod unit 72 is slightly slanted counterclockwise, the connecting end of the rod unit 72 is closer (than usual) to the connecting body 71 as the connecting body 71 rotates clockwise, providing less damping effect. Due to the tension of the resilient member is adjustable, the damping of the pedal system can be adjusted as desired, so as to meet the player's tendency and to further achieve a better performance effect.

To achieve the above mentioned effect, the support element may be formed with a sliding rail (not shown) instead of the sleeve 14. An orientation of the sliding rail is perpendicular to that of the upright frame. A lower end of the rod unit is slidably disposed in the slidable rail and is selectively positioned by the positioning element. As such, the connecting end of the rod unit is also movable to alter the tension of the resilient member as well as the angle included between the resilient member and the upright frame.

What is claimed is:

1. A pedal system for a drum, comprising:

a support element, having a pedal and at least one upright frame, the pedal being swayable between a release position and a percussion position, an axle being rotatably disposed on the upright frame;

a connecting shank, disposed on the axle in a rotational operative relationship;

a transmission element, connecting between the pedal and the connecting shank, the connecting shank being rotatable as the pedal pivoting between the release position and the percussion position; and a returning element, comprising a connecting body, a rod unit, a positioning element and a resilient member, the connecting body being disposed on the axle in a rotational operative relationship, the resilient member connecting between the connecting body and a connecting end of the rod unit, the resilient member providing a resilient force to retain the axle to a predetermined position so as to move the pedal to the release position, the connecting end of the rod unit being movable with respect to the support element so as to adjust an angle included between an orientation of the resilient member and that of the upright frame, the positioning element selectively fixing a relative position between the rod unit and the support element, so as to further fix the angle.

2. The pedal system of claim 1, wherein the returning element further comprises a cylindrical body rotatably disposed on the support element, the rod unit is radially disposed on the cylindrical body, the positioning element selectively positions the cylindrical body with respect to the support element.

3. The pedal system of claim 2, wherein the support element comprises a sleeve disposed on the upright frame, an axis of the sleeve is perpendicular to the orientation of the upright frame, the cylindrical body is received in the sleeve, the positioning element selectively urges the cylindrical body to tightly abut against the sleeve.

4. The pedal system of claim 3, wherein the sleeve has two opposite first bores for the rod unit to radially insert through the sleeve, two threaded units threadedly engage with the rod unit and locate at opposite sides of the sleeve to clamp the sleeve therebetween.

5. The pedal system of claim 2, wherein the support element comprises a sleeve disposed on the upright frame, an axis of the sleeve is perpendicular to the orientation of the upright frame, the sleeve has a second bore disposed on a periphery thereof, the cylindrical body is received in the sleeve, the positioning element inserts through the second bore and selectively urges the cylindrical body to tightly abut against the sleeve.

6. The pedal system of claim 5, wherein the sleeve has two opposite first bores for the rod unit to radially insert through the sleeve, two threaded units threadedly engage with the rod unit and locate at opposite sides of the sleeve to clamp the sleeve therebetween.

7. The pedal system of claim 1, wherein the support element is formed with a sliding rail whose orientation perpendicular to that of the upright frame, a lower end of the rod unit is slidably disposed in the slidable rail and is selectively positioned by the positioning element.

8. The pedal system of claim 1, further comprising a fixation element disposed on the axle in a rotational operative relationship, a drum hammer is disposed on the fixation element.

9. A drum assembly using the pedal system of claim 8, comprising at least one drum skin for the drum hammer to strike thereupon.

* * * * *